US005705984A

United States Patent [19]

Wilson

[11] Patent Number: 5,705,984

[45] Date of Patent: Jan. 6, 1998

[54] PASSIVE INTRUSION DETECTION SYSTEM

[75] Inventor: Douglas H. Wilson, Mystic, Conn.

[73] Assignee: The United States of America as represented by the Secretary of the Navy, Wasington, D.C.

[21] Appl. No.: 649,862

[22] Filed: May 10, 1996

[51] Int. Cl.[6] ..... G08B 13/26

[52] U.S. Cl. ..... 340/561; 340/562; 340/552; 340/566

[58] Field of Search ..... 340/561, 562, 340/552, 566

[56] References Cited

U.S. PATENT DOCUMENTS

| | | | |
|---|---|---|---|
| Re. 29,896 | 1/1979 | Gilcher | 340/562 |
| 3,056,907 | 10/1962 | Costanzo | 340/562 |
| 4,197,529 | 4/1980 | Ramstedt et al. | 340/566 |
| 5,448,222 | 9/1995 | Harman | 340/566 |

*Primary Examiner*—Jeffrey Hofsass
*Assistant Examiner*—Sihong Huang
*Attorney, Agent, or Firm*—Michael J. McGowan; William F. Eipert; Prithvi C. Lall

[57] ABSTRACT

An intrusion detection system. An RF energy source transmits energy into a transmission cable that has a characteristic impedance subject to change by deformation of the cable. The cable is buried along a path that corresponds to a perimeter to be monitored. When an intruder places weight in the vicinity of the cable, the cable deforms and changes its characteristic impedance. Consequently a portion of energy transmitted into the cable reflects back where time-domain or frequency-domain reflectometry apparatus uses the reflected energy to identify the location of the intrusion along the cable and provide other characteristics of the intruder.

22 Claims, 7 Drawing Sheets

PASSIVE INTRUSION DETECTION SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to intrusion detection systems and more particularly to intrusion detection systems for securing a wide area and providing the specific location of any intrusion and information about the intruder.

(2) Description of the Prior Art

It is common practice to monitor the perimeter of a building or other area for unauthorized entry by an intruder. In such situations it is also highly desirable to pin point the exact location of an intrusion and ascertain the intruder's identity, using "intruder" to designate either an individual or animal or an object such as a vehicle.

Some prior art intrusion detection systems incorporate switches, pneumatic or piezoelectric sensors or the like at key access points to provide a notice of entry. Often times these sensors can define only a general area of entry and normally do not provide any information related to the nature of the intruder. These systems require complex wiring and large numbers of sensors that are often located in adverse environments and are often visible.

Other types of intrusion detection systems utilize various properties of optical or RF transmission cables for ascertaining a specific entry location or information concerning an intruder. For example, U.S. Pat. No. 4,415,885 to Mongeon (1983) discloses an intrusion detector having "leaky" RF transmission cables so that a portion of the RF energy from a transmitter cable escapes and is picked up on a physically parallel, proximate receiving cable, both of which are normally buried. In accordance with that system, the receiving cable receives signals from the transmitting cable over two paths. One is a direct path from the transmit cable. The second is a path from the intruder along which reflected energy travels. The signal reflected from the intruder has a random phase and this system utilizes both sine and cosine detectors to respond to any phase shifts between the signals received along the two paths by indicating the presence of an intruder in the vicinity of the cables.

In U.S. Pat. No. 4,482,890 to Forbes et al. (1984) an intrusion detection system includes a light source that transmits light pulses to a detector through a transmitting optical fiber, an optical terminator and a receiving optical fiber, both fibers being either stepped index fibers or poor quality graded index fibers. The fibers are disposed in intimate contact throughout their length within a buried cable laid around the perimeter of a site to be guarded. Compression of the cable that occurs wherever an intruder crosses the cable, causes micro-bending that permits light pulses to break through from one fiber to the other. The time interval between the arrival at the detector of a light pulse received from the source after passage through the total length of the transmitting fiber and the receiving fiber and arrival of a breakthrough pulse received after passage through the fibers only so far as the region of micro-bending and back again indicates the location of the compression. The amplitude of the breakthrough pulses and their number are respectively dependent upon the extent of the micro-bending, such as by the compression forces exerted by the intruder and the duration of those forces. Consequently the information available in the breakthrough pulses is indicative of intruder type. Additional information can be recognized by multiple time displacements with separations containing additional information such as wheel or axle spacing or separate crossings of several intruders.

U.S. Pat. No. 5,134,386 to Swanic (1992) discloses an intruder detection system in which a microbend-sensitive optical fiber is embedded in a thin, pliable padding and laid under an area to be protected. An amplitude-modulated optical light beam source directs light energy into one end of the fiber. The light beam is recovered from the other end and the angular phase shift between the transmitted and recovered light beams is continuously measured and sampled at desired sample intervals. A change in the measured phase shift between any two sequential sample cycles indicates an intruder, and the magnitude of the phase shift is a function of the mass of the intruder. The pattern of repetitive phase shift differences over time provides an estimate of the dynamic characteristics of the intruder. Although this particular patent discloses a method of analyzing the mass or other characteristics of an intruder entity, it does not disclose any means for identifying the location of the intrusion along the length of the sensing cables.

Thus, although the Forbes patent discloses a structure that provides both the location of an intruder and information concerning the characteristics of the intruder, the Forbes patent, like the Mongeon and Swanic patents, requires two cables throughout the area to be monitored. The systems in the Mongeon and the Forbes patent also require structures at both ends of the cable to operate, albeit in the Forbes patent that structure is a mirror structure. The use of double cables increases the overall expense and can complicate the structure unduly. Moreover in each of these references the cables are in series. There is no indication that any of these systems can be utilized in series and parallel relationships.

SUMMARY OF THE INVENTION

Therefore it is an object of this invention to provide an intrusion detection system that utilizes a single end-fed transmission cable as a sensor.

Still another object of this invention is to provide an intrusion detection system that utilizes a single end-fed transmission cable for localizing an intrusion and providing information about the intruder.

Still another object of this invention is to provide an intrusion detection system that utilizes a single end-fed transmission cable that is adapted for operation with other sensors.

Yet another object of this invention is to provide an intrusion detection system that utilizes a single end-fed transmission cable that can sense multiple, simultaneous intrusions.

Yet another object of this invention is to provide an intrusion detection system that utilizes a single end-fed transmission cable that can be connected with other like transmission cables in parallel.

In accordance with one aspect of this invention a system for detecting any intrusion past the perimeter of an area includes a transmission cable that circumscribes the area and has a characteristic that is normally constant throughout its length, but that, at any point, can change in response to a physical condition that represents an intrusion. The cable is energized to reflect energy from any point along the length of the cable at which the characteristic differs from the normal characteristic. The reflected energy is monitored to produce an indication that an intrusion has occurred and the location of that intrusion.

In accordance with another aspect of this invention, an intrusion detection system for detecting any intrusion past an area perimeter includes an RF transmission cable that has first and second conductors spaced by an insulating material thereby to have a characteristic impedance throughout its length that, at any point, can change in response to a change in the spacing of the conductors. The cable is buried at a depth that enables the spacing change to occur in response to weight being applied proximate the perimeter and the buried cable. A transmitter directs electrical energy into one end of the transmission cable. A portion of that electrical energy is reflected from any point in the cable that has an impedance that differs from the characteristic impedance. A reflectometer circuit connects to the one end of the cable for producing an indication that an intrusion has occurred and the location of that intrusion in response to the reflected energy.

BRIEF DESCRIPTION OF THE DRAWINGS

The appended claims are intended to point out with particularity and to claim distinctly the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
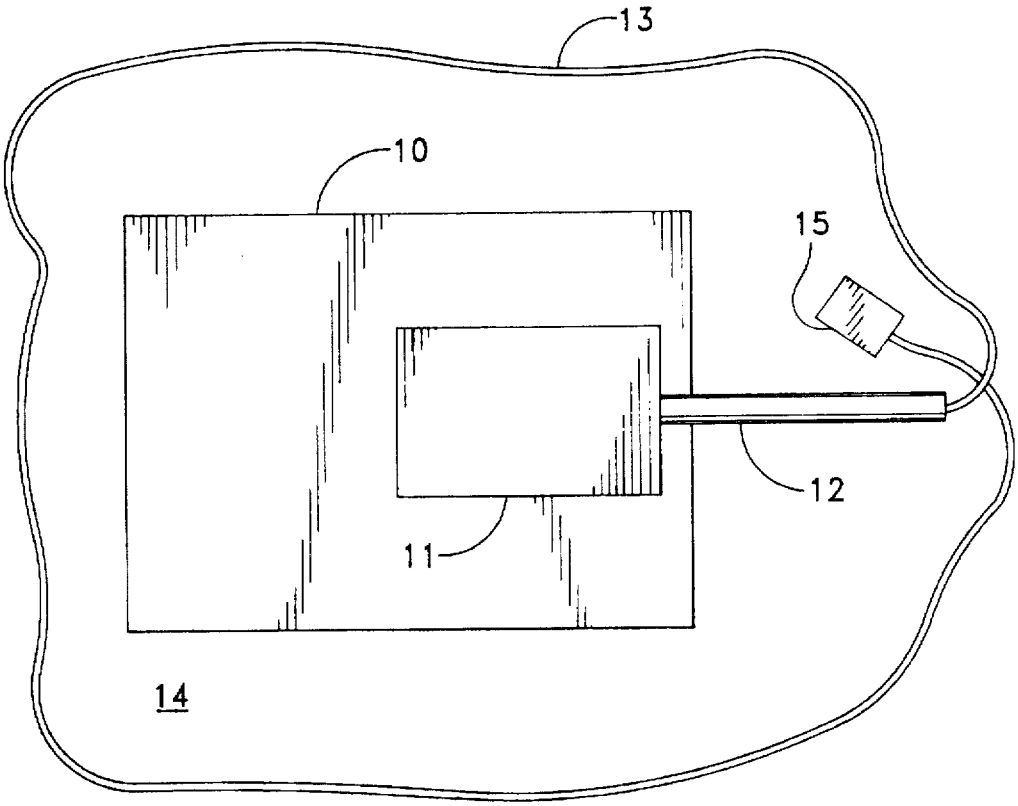
FIG. 1 depicts the basic components of an intrusion system constructed in accordance with this invention.

FIG. 1 depicts an intrusion system in accordance with this invention for purposes of establishing a basic understanding of the fundamental construction and operation of this invention. In FIG. 1 a building 10 and surrounding area are monitored by the intrusion system that includes electronics 11, an optional feed cable 12 and a transmission cable 13. In this particular embodiment the building 10 houses the electronics 11. The electronics 11 transmits signals to and receive signals from the transmission cable 13 through the feed cable 12. The transmission cable 13 lies about the perimeter of the area 14 to be monitored and terminates at the end remote from the electronics 11 in a termination circuit 15. As will become apparent, the feed cable 12 can merely comprise a portion of the transmission cable 13 that is isolated by being located in a non-compressible structure, such as a section of electrical conduit.

Figure 1A:
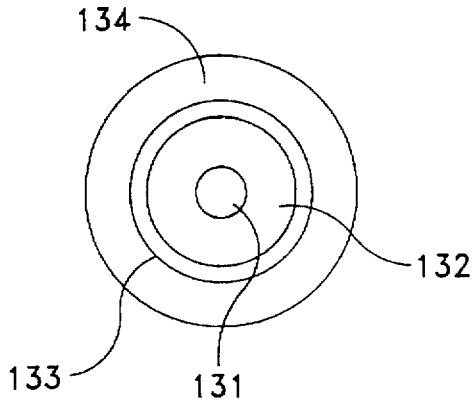
FIG. 1A is a cross section of a transmission cable useful in the intrusion system of FIG. 1.

The transmission cable 13 has a characteristic that is normally constant throughout the length of the cable and that, at any point, can change in response to a physical condition. For example, if the cable 13 is an electrical transmission line with coaxial, twisted pair or parallel conductors, the normally constant characteristic is its characteristic impedance that will change in response to deformation of the cable. FIG. 1A depicts a typical coaxial transmission cable 13 having an inner or central conductor 131, an insulating or dielectric layer 132, an encompassing outer conductor 133 and an outer insulating jacket 134. If a mechanical force deforms a portion of the cable 13 and changes the spacing between the inner conductor 131 and outer conductor 133, the characteristic impedance at the point of deformation changes.

In use the electronics 11 energizes the cable 13 with energy, usually RF energy. The impedance of the termination circuit 15 matches the characteristic impedance of the transmission cable 13 so energy does not reflect back to the electronics 11. If at any other point over the length of the transmission cable 13 the normally constant characteristic impedance changes, a portion of the energy reflects back to the electronics 11 where other circuitry monitors reflected energy and determines from the reflected energy the fact that an intrusion has occurred, the location of the intrusion and, with appropriate circuitry, characteristics of the intruder.

Figure 2:
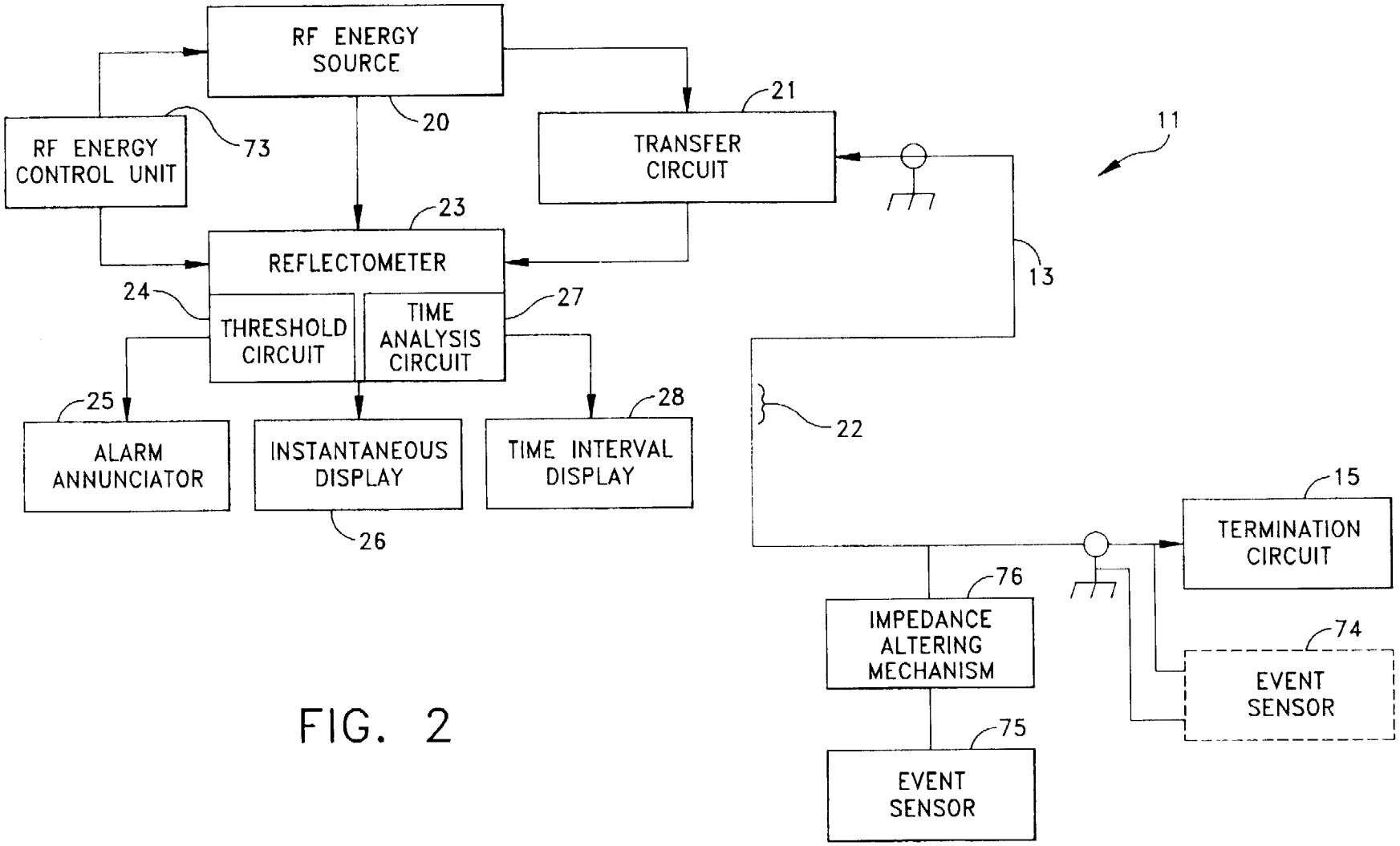
FIG. 2 depicts an intrusion system such as shown in FIG. 1 in more detail.

In the particular embodiment shown in FIG. 2, an RF energy source 20 and transfer circuit 21 in the electronics 11 feeds the coaxial transmission cable 13 directly, eliminating any separate feed cable 12 as shown in FIG. 1. The transfer circuit 21 will be needed to separate the transmitted RF energy from the reflected energy. In practice, the transfer circuit 21 will be a directional coupler or similar device. Transfer circuit 21 separates the incident RF energy generated by RF energy source 20 from any reflected energy and directs the incident RF energy onto transmission cable 13 while directing any reflected energy to reflectometer 23. Such transfer circuits are well known in the art.

Still referring to FIG. 2 and in accordance with this invention, a reflectometer 23 analyzes the reflected energy to localize the site of any impedance discontinuity that produces reflected energy. In a particular application the reflectometer 23 might incorporate a threshold circuit 24 for energizing an alarm annunciator 25 when the reflected energy exceeds some predetermined threshold. The electronics 11 shown in FIG. 2 also includes an instantaneous display 26, a time analysis circuit 27 and a time interval display 28. The instantaneous display 26, if included, constantly monitors the reflected energy. The time analysis circuit 27, if included, operates in a cyclic mode to monitor the reflected energy over time to provide information to the time interval display 28. For example, if the RF energy source is supplied as a train of discrete pulses, the time analysis circuit 27 could operate on a repetition rate corresponding to the pulse repetition frequency and upon the characteristics of the RF energy source 20 to display the amplitude of the reflected energy received from each pulse for some number of consecutive pulses localized for a particular site along the cable. In whatever form, the alarm annunciator 25, instantaneous display 26, time analysis circuit 27 and time interval display 28 provide monitoring that announces each and every change in the characteristic impedance of the RF transmission cable 13.

Reflectometers generally operate in a time-domain or frequency-domain mode to measure the reflection characteristics of a transmission system such as a cable by monitoring the RF energy entering the system and the resulting reflected energy, if any, returned by the transmission system. In a time-domain mode (commonly referred to as time-domain reflectometry), the reflectometer measures and indicates the time interval between the transmission of a pulse and the arrival of reflected energy as well as the magnitude of the reflected energy. The time interval can be correlated directly to a location along the transmission cable for display, as on a CRT or other instantaneous display 26 in FIG. 2.

In a frequency-domain mode (commonly referred to as frequency-domain reflectometry), the reflectometer monitors the transmitted RF energy and the reflected energy and, using correlation techniques such as matched filter processing or the like, yields information on the time interval between the transmission of RF energy and the arrival of reflected energy and on the magnitude of the reflected energy. In frequency-domain reflectometry the transmitted RF energy is typically a variable RF frequency signal such as that generated using pulse compression techniques, an FM chirp, pseudo-random noise, or similar modulation techniques.

The selection of one or the other of time-domain or frequency-domain reflectometers and the operating parameters for the selected reflectometer depend upon a number of factors associated with a particular monitoring site. In terms of a time-domain system the minimum resolution along the transmission cable 13 determines the upper limit for the length of any pulse from the RF energy source. A resolution of 1 meter requires a maximum pulse width of 5 nanoseconds assuming the transmission cable propagation speed is 0.67 times the speed of light. Generally the pulse repetition frequency will be less than the reciprocal of the time for a round trip passage of the energy through the monitored section of the transmission cable 13. The length of any feed cable, such as feed cable 12 in FIG. 1, can be disregarded in determining the pulse repetition frequency. This may result in multiple pulses traveling between the RF energy source 20 and the termination circuit 15 simultaneously. However, any reflections from the feed cable portion can be disregarded. For a 2000-meter perimeter, the round trip travel time will be 20 microseconds so the maximum pulse repetition frequency would be 50 Khz. Slower pulse repetition frequencies may be used in view of other circumstances. For example, if it is certain that any intruder will produce a change in the characteristic impedance for an interval of at least one millisecond, the pulse repetition frequency could be reduced to about 2 or 3 Khz in accordance with conventional sampling criteria.

Figure 3A:
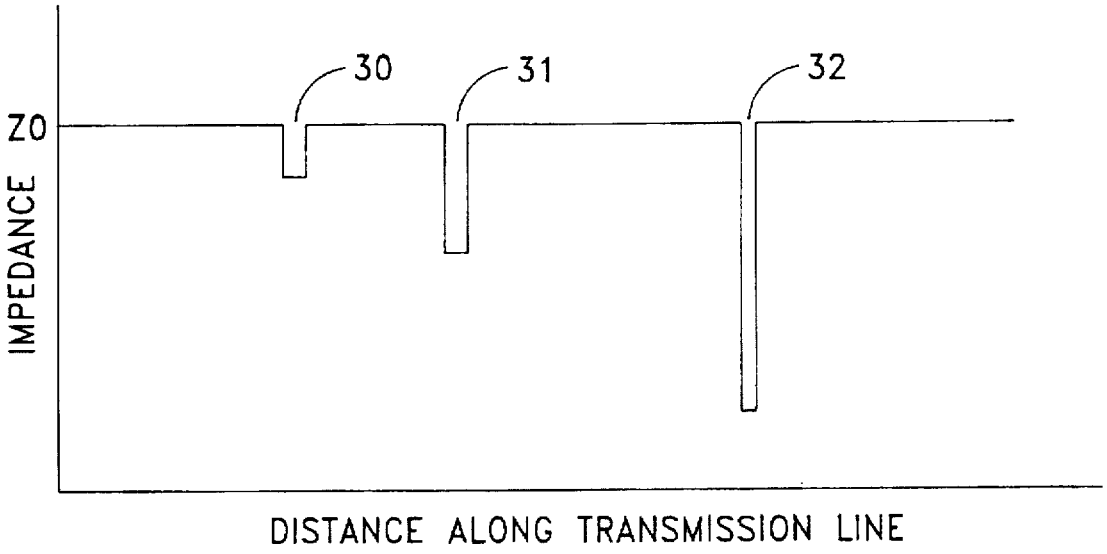
FIGS. 3A and 3B depict impedance and reflected signal characteristics in connection with the system of FIGS. 1 and 2.

In order to more fully understand this invention, it will be helpful to describe the specific operation of the system in FIG. 2 in more detail assuming that the reflectometer 23 is a time-domain reflectometer. FIG. 3A depicts the characteristic impedance as a function of distance along the transmission cable 13 in FIG. 2. Locations 30, 31 and 32 represent changes in the characteristic impedance caused by various conditions at corresponding locations. Locations 30 and 31 have approximately the same extent along the cable 13, but have differing magnitudes. The change at location 32 produces an even greater change in the impedance, but over a shorter distance.

Figure 3B:
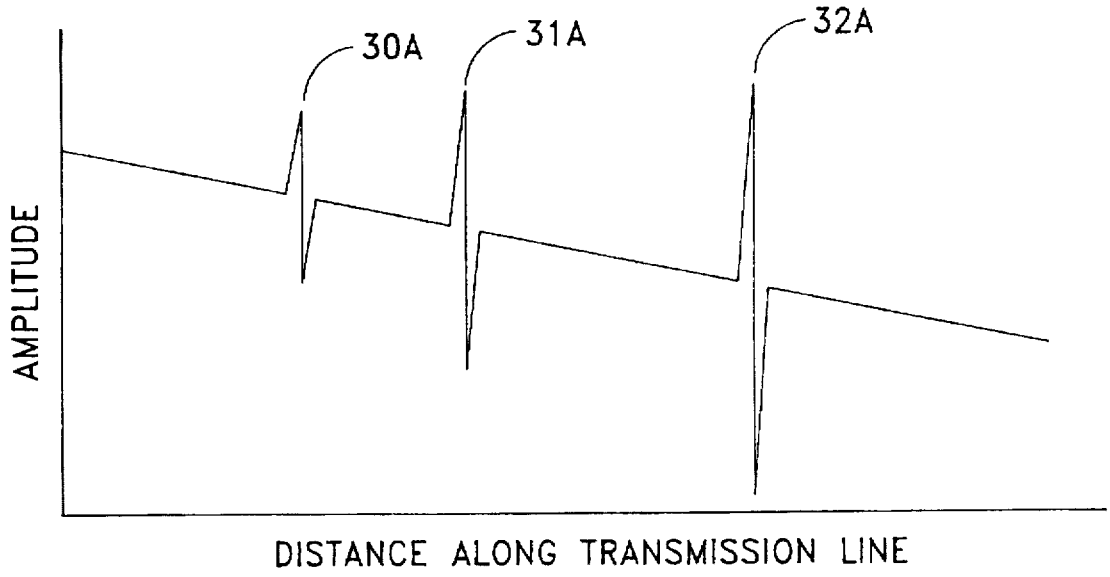

FIG. 3B shows a typical time domain reflectometer trace that occurs in response to a single RF pulse if the three changes in the characteristic impedance shown in FIG. 3A occur simultaneously. By simultaneously, it is meant that the conditions that are causing the changes in the characteristic impedance shown in FIG. 3A are affecting the cable 13 at the time that the single RF pulse propagates through the corresponding locations 30, 31 and 32 along the cable 13. As can be seen in FIG. 3B, the resulting trace contains three pulses 30A, 31A and 32A which correspond to the three changes in the characteristic impedance depicted in FIG. 3A. While the display in FIG. 3B actually represents changes in impedance as a function of time of propagation along the cable, knowledge of the propagation characteristics of the transmission cable enables the conversion of time directly to distance. The distance along the horizontal axis in FIG. 3B therefore corresponds to distance along the cable 13. The height of each of the pulses 30A, 31A and 32A corresponds to the magnitude of the change in characteristic impedance. Moreover, unless the transmission cable 13 were to be short or open circuited at any intermediate location, each impedance discontinuity will reflect only a portion of the energy transferred toward the termination circuit 15 in FIG. 2. As a result, a display, such as the instantaneous display 26 in FIG. 2, has the capacity to indicate multiple simultaneous intrusions and to locate each intrusion.

Thus, as just described, FIG. 3B can be used to identify any changes in the cable impedance and the magnitude thereof as a function of the distance along the cable 13. Furthermore, because this display is generated in response to a single RF pulse propagating from the RF energy source 20 to the termination circuit 15 and the time that it takes the pulse to pass through the length of the cable 13 is very short as compared to the time that a typical intruder will influence the cable impedance, FIG. 3B can be thought of as a "snapshot" of the cable impedance at a single point in time. Therefore, while a display such as that shown in FIG. 3B can be used to identify and to locate multiple simultaneous intrusions at a single point in time, it is difficult to use this display to track the change in impedance over time for a particular location along the length of cable 13. A display showing the change in impedance over time (herein referred to as a time history) for a particular location along the cable 13 enables one to determine the pattern established as an intruder passes over the particular location.

Time analysis circuit 27 can be included to generate time histories for particular locations along the cable 13 for display by time interval display 28. A time history can be generated by sampling the amplitude of any reflected pulse received from a particular location along the cable 13 for each pulse in a succession of pulses launched into the cable and storing the sample in a time history bin corresponding to that location along the cable. For example, to generate a time history for a location that is 1000 meters from the RF energy source 20, time analysis circuit 27 would store the amplitude of the reflected energy received 10 μs (round-trip travel time assuming propagation speed is 0.67 times the speed of light) after the RF pulse is launched into the cable. After sampling the reflected energy received from a number of pulses, the information in a time bin for a particular location can be graphed (amplitude vs. time) to determine the pattern established as an intruder passes over a particular location on the cable. Circuitry for producing such operations are well known in the art, so FIG. 2 merely depicts one such circuit in the form of the time analysis circuit 27 and time interval display 28.

Figure 4A:
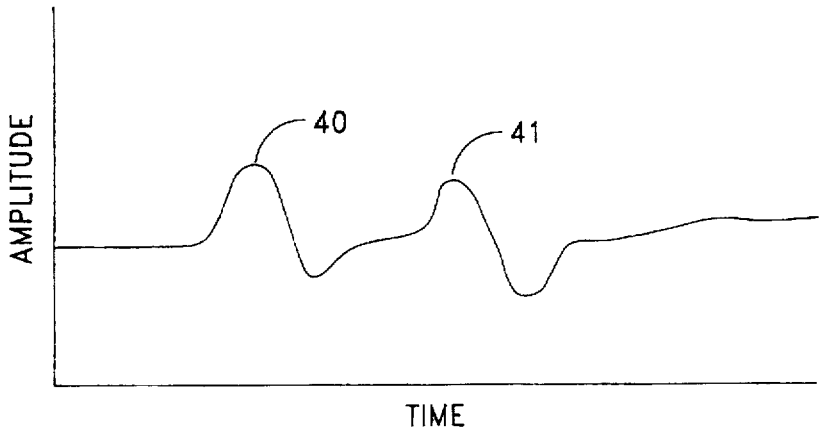
FIGS. 4A through 4C depict time history waveforms for different types of intruders developed from signals such as shown in FIG. 3B.
Figure 4B:
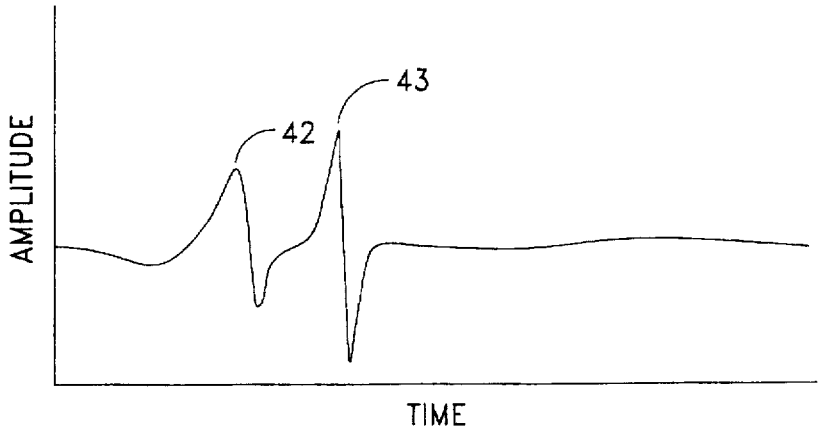
Figure 4C:
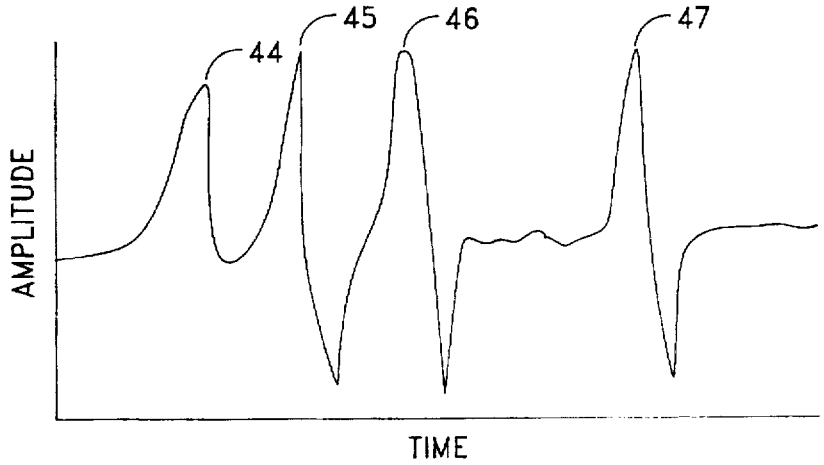

FIGS. 4A through 4C depict the time history waveforms that might occur as a result of different intruders. FIG. 4A, for example, depicts that amplitude and timing of a person stepping in the region or area 14 in FIG. 1 with a first step at 40 and a second step at 41. FIG. 4B depicts the characteristics of an automobile as an intruder wherein a first set of wheels passes the cable at 42 and the other set at 43. A comparison of FIGS. 4A and 4B demonstrates that the amount of deformation produced by the passage of the car axles is greater than that of an individual and that the time interval between points 42 and 43 is much shorter. FIG. 4C depicts the signals that could appear as a tractor trailer passes over the cable 13 with the front wheels of the tractor producing the signal at 44 and the rear tractor and front and rear trailer wheels producing the signals at 45, 46, and 47 respectively. Consequently an analysis of the pattern with time for a particular location can assist in identifying the nature of the intruder.

As will now be shown, the transmission cable 13 can be buried to provide covert sensing so an intruder does not have to step on a cable directly. For a given application, soil mechanics, the perimeter to be monitored, the minimum weight to be detected and other criteria must be considered to arrive at a particular cable selection and burial depth. Transmission cable parameters of compressibility and loss per unit length and of suitability for burial in a particular environment and for operation in a particular temperature range are also important.

Figure 5A:
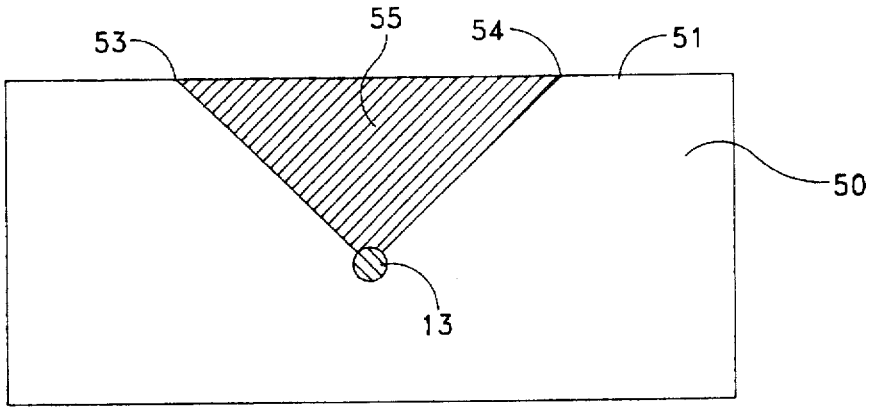
FIGS. 5A through 5C depict regions of influence and system responses that are useful in understanding the operation of the system shown in FIG. 2.
Figure 5B:
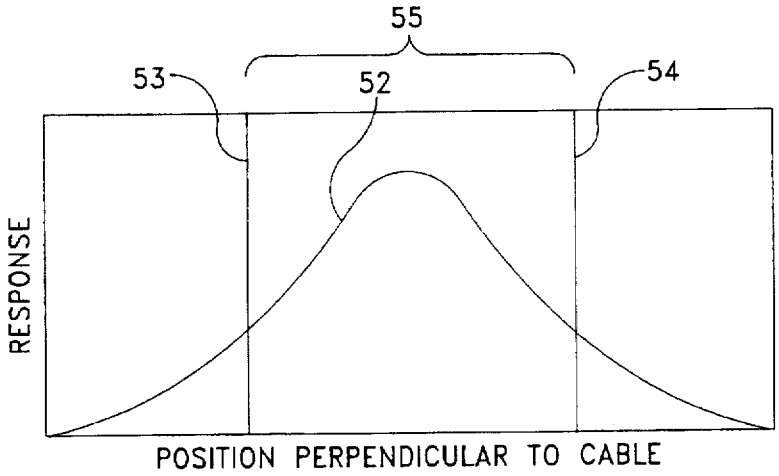
Figure 5C:
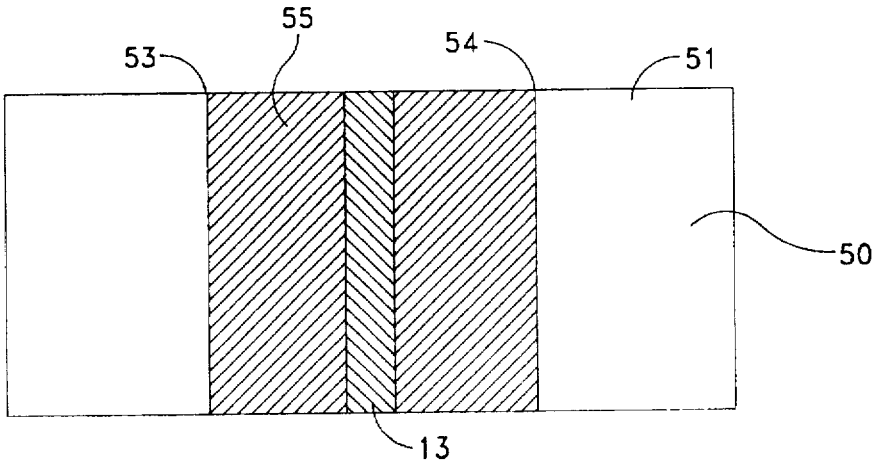

When the transmission cable 13 is buried in ground 50 as shown in FIG. 5A, it has a characteristic response region determined primarily by the foregoing criteria. As an approximation, it is known that a force applied on the surface 51 will extend downwardly and expand at some angle outwardly from a vertical axis through the point of contact. For the purpose of illustration an angle of 45° is used to identify an exemplary response region. Conversely, applying a constant force on the surface 51 at different locations relative to the transmission cable 13 will have different influences on the magnitude of the change in characteristic impedance. FIG. 5B shows a response curve 52 for different positions relative to the location of cable 13 and the half maximum value boundaries 53 and 54. These boundaries define the region of influence 55 that is shown in cross-section in FIG. 5A and in a planar view in FIG. 5C across the surface 51 of the ground 50. The height at the peak of the curve 52 in FIG. 5B depends upon the depth at which the cable 13 is buried below the surface 51, the weight of the intruder and the previously mentioned soil and cable mechanical properties. Generally the peak aligns vertically over the transmission cable 13; however, in a specific situation, the peak may be offset from the transmission cable 13.

Figure 6A:
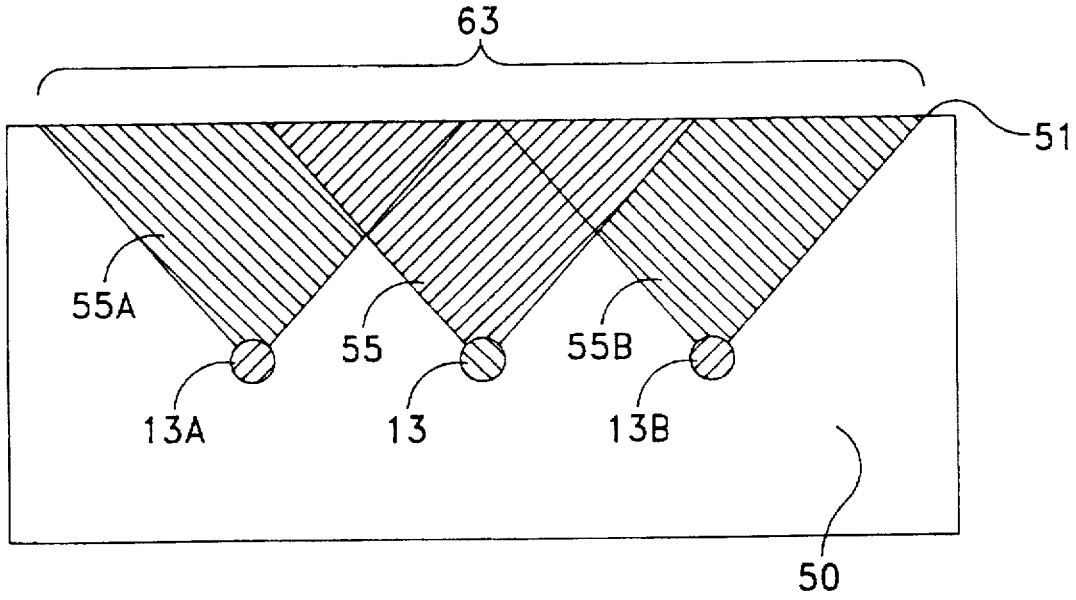
FIGS. 6A and 6B depict an approach for increasing the regions of influence shown in FIGS. 5A through 5C.
Figure 6B:
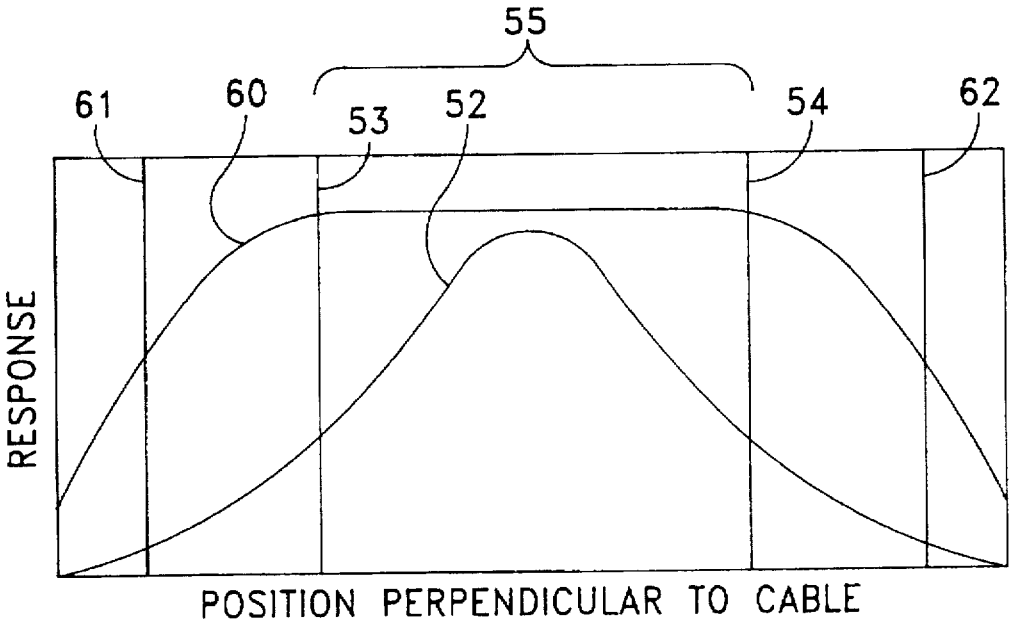

It is possible to increase the region of influence 55 shown in FIG. 5A by connecting transmission cables in parallel. FIG. 6A for example, depicts cable 13 flanked by parallel cables 13A and 13B. Each has a region of influence 55, 55A and 55B respectively with respect to a force applied to the surface 51 of the ground 50. FIG. 6B depicts the response curve 52 for the cable 13 and a second response curve 60 that depicts the combined region of influence for the cables 13, 13A and 13B and the half-maximum value boundaries 61 and 62. Laying the three cables 13, 13A and 13B in parallel therefore increases the region of influence shown in FIG. 6B from the region 55 to a larger region 63.

Figure 7:
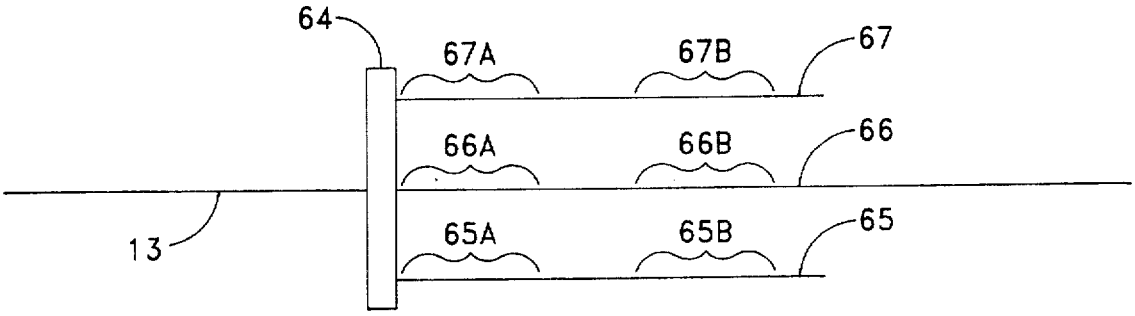
FIG. 7 shows a parallel cable connection in accordance with another aspect of this invention.

FIG. 7 depicts one approach for obtaining an increased region of influence shown in FIG. 6B by using transmission cables in parallel. In this particular embodiment the transmission cable 13 feeds a connector 64 from which three RF transmission cables 65, 66 and 67 extend in parallel. Each of these cables 65, 66 or 67 could have the same or different lengths depending on a particular application for the intrusion detection system. In this particular embodiment, the parallel cables are divided, for purposes of explanation, into spaced length sections 65A and 65B along the cable 65, length sections 66A and 66B along the cable 66 and length sections 67A and 67B along the cable 67. Thus the portions 65A, 66A and 67A define one possible area of entry that is transverse to the cables 65 through 67 while portions 65B, 66B and 67B define another distinct area of entry. This configuration has the advantage of increasing the region of influence and of using the same monitoring electronic resources as a single cable. However, changes in cable impedance at corresponding points along any of the parallel cables show up in the monitoring electronics at the same time delay or position along the system. That is, changing the characteristic impedance at length sections 65A, 66A or 67A causes a signal to appear at the same electrical time delay on the display 26 in FIG. 2, so events at 65A, 66A and 67A can not be differentiated from each other. However, the cable layout does enable the monitoring system to distinguish an intrusion across length sections 65A, 66A and 67A from an intrusion across length sections 64B, 65B and 66B.

Figure 8:
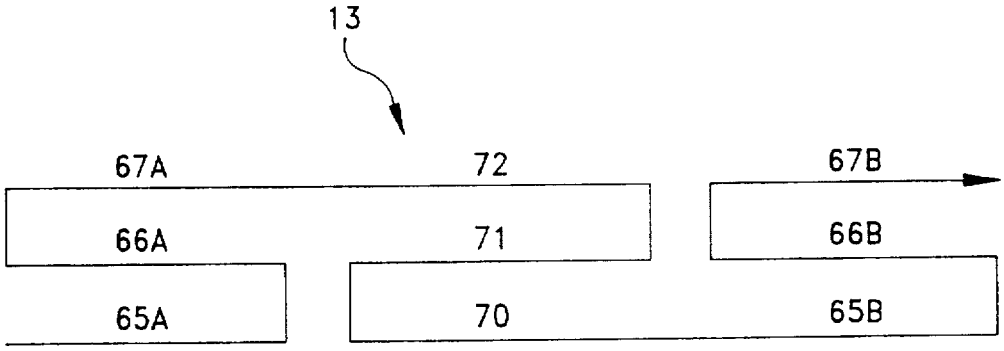
FIG. 8 depicts a serpentine serial connection for use in accordance with this invention.

FIG. 8 depicts a cable layout that overcomes this problem while still increasing the region of influence. In FIG. 8 length sections 65A through 67B have been disclosed in corresponding relationships to those shown in FIG. 7 and intermediate length sections 70 through 72 have been added. However, the transmission cable 13 remains in an electrically serial configuration, so the electronics 11 in FIG. 2 can locate and distinguish any response to an intrusion on any length section of the cable. That is, the display 26 in FIG. 2 could discriminate events as an intruder crossed length sections 65A, 66A and 67A for example.

In the operation of any of the foregoing or other embodiments, the pulse generator 20 issues energy pulses as discrete pulses for time domain reflectometry or as variable frequency signals for frequency-domain reflectometry at a pulse repetition frequency in which the pulse duration is in the order of a few nanoseconds and the time between adjacent pulses is in the order of microseconds. Specific values will be determined by sampling requirements and cable lengths for a given application. In each system an RF energy source 20 transfers RF energy onto the cable 13 with sufficient energy to overcome any losses in the cable and any loss of energy due to a reasonable number of reflections. If a reflection occurs from one or more locations, those multiple reflections, such as shown in FIG. 3B, are displayed. Each can further be identified by time position correlations into a display such as shown in FIGS. 4A through 4C.

Thus the system shown in FIG. 2 and as described with the remaining figures, achieves the objectives of this invention. Specifically, an intrusion detection system constructed in accordance with this invention operates with a single end-fed transmission cable and eliminates the need for any cable dedicated to the return of energy to the monitoring electronics. The system is capable of detecting multiple simultaneous intrusions, localizing each intrusion and, by analyzing the magnitude and time history for each intrusion, providing other information concerning the intruder. Moreover, the system is further adapted for monitoring and identifying a wide range of intruders.

FIG. 2 shows additional variations of the basic intrusion system. In one variation, the electronics 11 includes an RF energy control unit 73 that connects to the RF energy source 20 and reflectometer 23. The control unit 73 could be used to change the pulse width or pulse repetition frequency when the reflectometer 23 is a time-domain reflectometer or to change the frequency pattern, iteration interval or other characteristics of the RF signal for use with a frequency-domain reflectometer. With such a pulse control unit 73, the system in FIG. 2 can be reconfigured in real time without any need to interrupt the sensing operation. With frequency domain reflectometry, the pulse control 73 could generate a sweep over a wide band with a long interval to monitor the transmission cable 13 as a whole. Detection could then cause the control unit 73 to shorten the interval to locate the site or sites of an intrusion with better spatial resolution. Alternatively, both modes could operate independently, but simultaneously and multiple high resolution signals could be transmitted simultaneously.

In another alternative, an event sensor 74 is located at the end of the transmission cable 13 remote from the electronics 11. The event sensor 74 could be a conventional sensor that would even operate with DC or low frequency AC signals that could be carried over the transmission cable simultaneously with the RF pulses. The event sensor 74 could be connected in parallel with the termination circuit 15 or could replace termination circuit 15 so long as the connection of the event sensor 74 to the end of the transmission cable 13 did not alter the normal termination impedance.

In accordance with another variation, another event sensor 75 could be located at any position along the cable to detect some other event or intrusion characteristic. The event sensor 75 would control an impedance altering mechanism 76 that might compress the coax cable or otherwise alter the normally constant characteristic of the cable. For example, the event sensor 75 might be a temperature monitor that would change the characteristic of the transmission cable 13 if the measured temperature deviated from a set temperature range. At the display this alarm would be identified by its position along the transmission cable 13.

Thus the basic system disclosed in FIG. 2 is readily adapted for a number of applications which, although typically directed to detecting the intrusion into an area, can also incorporate sensing of other parameters such as temperature. As indicated, however, the transmission cable 13 can be implemented with other types of RF transmission lines, optical transmission lines or other energy transmission media having a characteristic that, when changed, produces a partial reflection of any energy injected at one end back to that end. Specific types of sensors and a variety of cable configurations have also been disclosed. Thus, although this invention has been disclosed in terms of certain embodiments including an RF coaxial transmission cable as a sensor, it will be apparent that many other modifications can be made to the disclosed apparatus without departing from the invention. Therefore, it is the intent of the appended claims to cover all such variations and modifications as come within the true spirit and scope of this invention.

What is claimed is:

1. A system for detecting any intrusion past a perimeter of an area, said system comprising:

RF transmission cable means at the perimeter, said RF transmission cable means having a conductor structure consisting of first and second conductors and having a dielectric material separating said first and second conductors, said RF transmission cable means having a characteristic impedance that is normally constant throughout its length and that, at any point, can change in response to a physical condition that represents an intrusion;

RF generating means attached to a first end of said RF transmission cable means for energizing said cable means with RF energy, a portion of the RF energy being reflected from any point along the length of said RF transmission cable means at which the impedance differs from the normal characteristic impedance; and means for monitoring the energy reflections thereby to produce an indication that an intrusion has occurred and the location of that intrusion.

2. An intrusion detection system as recited in claim 1:

wherein said RF transmission cable means terminates at a second end remote from said RF generating means in a corresponding termination impedance; and wherein said monitoring means includes reflectometry means for determining the location of source of a reflection of the RF energy.

3. An intrusion detection system as recited in claim 2:

wherein said RF generating means produces periodic RF pulses for energizing said RF transmission cable means; and wherein said reflectometry means comprises means for determining the position of each reflection by time-domain reflectometry.

4. An intrusion detection system as recited in claim 2:

wherein said RF generating means produces a variable RF frequency signal in an iterative fashion; and wherein said reflectometry means includes means for determining the position of each reflection by frequency-domain reflectometry.

5. An intrusion detection system as recited in claim 2 wherein said monitoring means additionally comprises time display means connected to said reflectometry means for displaying representations of the reflected RF energy over an expanded time interval.

6. An intrusion detection system as recited in claim 2 wherein the area comprises earth at the perimeter and said RF transmission cable means comprises a compressible RF transmission cable buried at the perimeter whereby weight applied to the surface of the earth at the perimeter deforms said transmission cable thereby to alter the impedance at a corresponding location.

7. An intrusion detection system as recited in claim 2 additionally comprising discrete sensor means for monitoring a condition, said sensor means having the characteristic impedance and being attached to the second end of the RF transmission cable means and said monitoring means additionally includes means for monitoring signals from said sensor means.

8. An intrusion detection system as recited in claim 2 additionally comprising means for altering the characteristic impedance of said RF transmission cable means in response to an external event.

9. An intrusion detection system as recited in claim 2 additionally comprising RF energy control means for controlling the characteristics of the RF energy applied to said RF transmission cable means.

10. An intrusion detection system as recited in claim 1 wherein said RF transmission cable means includes a first RF transmission cable, at least one additional RF transmission cable and connector means for connecting each additional RF transmission cable in parallel with at least a portion of the first RF transmission cable without changing the characteristic impedance.

11. An intrusion detection system as recited in claim 1 wherein said RF transmission cable means comprises a single RF transmission cable with portions thereof being positioned in a serpentine pattern whereby at least one portion lies physically essentially parallel to another portion.

12. An intrusion detection system as recited in claim 11 having at least one additional RF transmission cable and connector means for connecting each additional RF transmission cable in parallel with at least a portion of the single RF transmission cable without changing the characteristic impedance.

13. An intrusion detection system for detecting any intrusion past a perimeter of an area, said system comprising:

an RF transmission cable having a conductor structure consisting of first and second conductors arranged symmetrically about a central axis and having a dielective material that spaces said first and second conductors thereby to form a cable with a characteristic impedance throughout its length that, at any point, can change in response to a change in the spacing of the conductors, said RF transmission cable being buried at the perimeter at a depth that enables the spacing change to occur in response to weight applied proximate the buried cable and having first and second ends;

an RF energy source for directing RF energy into the first end of the transmission cable whereby a portion of the electrical energy in a pulse is reflected from any point in said RF transmission cable that has an impedance that differs from the characteristic impedance; and a reflectometer connected to the first end of the RF transmission cable for producing an indication that an intrusion has occurred and the location of that intrusion in response to reflected energy.

14. An intrusion detection system as recited in claim 13 wherein portions of said RF transmission cable extend in a serpentine fashion such that portions of the cable lie along essentially parallel paths.

15. An intrusion detection system as recited in claim 13 wherein said reflectometer uses time-domain reflectometry for determining the position of any intrusion along the cable.

16. An intrusion detection system as recited in claim 13 wherein said reflectometer uses frequency-domain reflectometry for determining the position of any intrusion along the cable.

17. An intrusion detection system as recited in claim 13 additionally comprising:

discrete sensor means for monitoring a condition, said sensor means having the characteristic impedance and being attached to the second end of the RF transmission cable; and means for monitoring signals from said sensor means.

18. An intrusion detection system as recited in claim 13 wherein said transmission cable comprises coaxial cable.

19. An intrusion detection system as recited in claim 13 additionally comprising time display means connected to said reflectometer for displaying representations of the reflected energy over a time interval.

20. An intrusion detection system as recited in claim 13 additionally comprising means for altering the characteristic impedance of said RF transmission cable in response to an external event.

21. An intrusion detector system as recited in claim 13 additionally comprising an RF energy control unit for varying the characteristics of said RF energy source during the operation of said intrusion detection system.

22. An intrusion detection system as recited in claim 13 wherein said RF transmission cable extends around the area and includes at least one additional RF transmission cable connected electrically in parallel thereto.

* * * * *